US011045685B2

(12) United States Patent
Martin, Sr.

(10) Patent No.: US 11,045,685 B2
(45) Date of Patent: Jun. 29, 2021

(54) ROTATABLE HANDLE FOR A DUMBBELL BAR

(71) Applicant: Marvin Martin, Sr., Chicago, IL (US)

(72) Inventor: Marvin Martin, Sr., Chicago, IL (US)

(73) Assignee: Marvin E. Martin, Sr., Homewood, IL (US)

( * ) Notice: Subject to any disclaimer, the term of this patent is extended or adjusted under 35 U.S.C. 154(b) by 143 days.

(21) Appl. No.: 16/573,582

(22) Filed: Sep. 17, 2019

(65) Prior Publication Data

US 2021/0077853 A1 Mar. 18, 2021

(51) Int. Cl.
*A63B 21/072* (2006.01)
*A63B 21/00* (2006.01)

(52) U.S. Cl.
CPC ..... *A63B 21/4035* (2015.10); *A63B 21/0724* (2013.01); *A63B 21/0726* (2013.01); *A63B 21/4049* (2015.10)

(58) Field of Classification Search
CPC ..... A63B 21/4049; A63B 21/4035; A63B 21/0722; A63B 21/0724; A63B 21/0726
See application file for complete search history.

(56) References Cited

U.S. PATENT DOCUMENTS

2005/0085352 A1* 4/2005 Baxter ..... A63B 21/0724 482/100
2006/0014615 A1* 1/2006 Godbold ..... A63B 23/12 482/141
2006/0035771 A1* 2/2006 Gant ..... A63B 21/4035 482/141
2008/0200318 A1* 8/2008 Hauser ..... A63B 23/1281 482/141
2011/0111929 A1* 5/2011 Allison ..... A63B 21/072 482/108
2013/0210589 A1* 8/2013 Thompson ..... A63B 21/0726 482/108
2015/0105224 A1* 4/2015 Odneal ..... A63B 21/0722 482/107
2017/0113089 A1* 4/2017 Martin, Sr. ..... A63B 21/0724
2021/0001165 A1* 1/2021 Stilson ..... A63B 21/0724

* cited by examiner

*Primary Examiner* — Joshua T Kennedy
(74) *Attorney, Agent, or Firm* — Martin Press Innovation LLC; Marvin E. Martin, Sr.

(57) ABSTRACT

A rotatable handle for a dumbbell bar that allows hand rotation to reduce the risk of shoulder injury. The rotatable handle includes a grip handle part that can be grasped by the user. The rotatable handle also includes an upper side and a lower side that are rotatable with respect to each other. A hard stop mechanism stops the rotation of the upper side so that the grip handle part stops rotating 5-15 degrees from parallel with the dumbbell bar clamped to the lower side. A clamping mechanism is attached to the lower side to secure the bar in place.

13 Claims, 8 Drawing Sheets

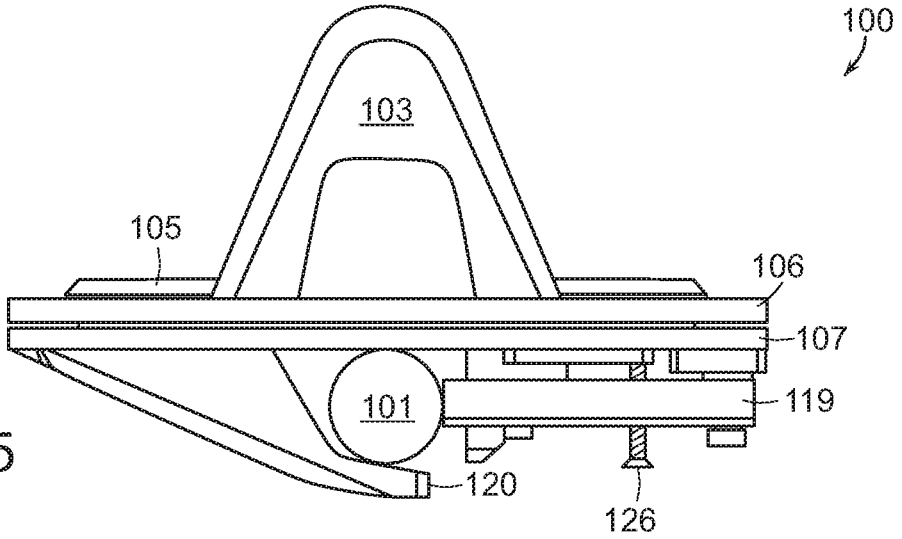
FIG. 5
FIG. 6
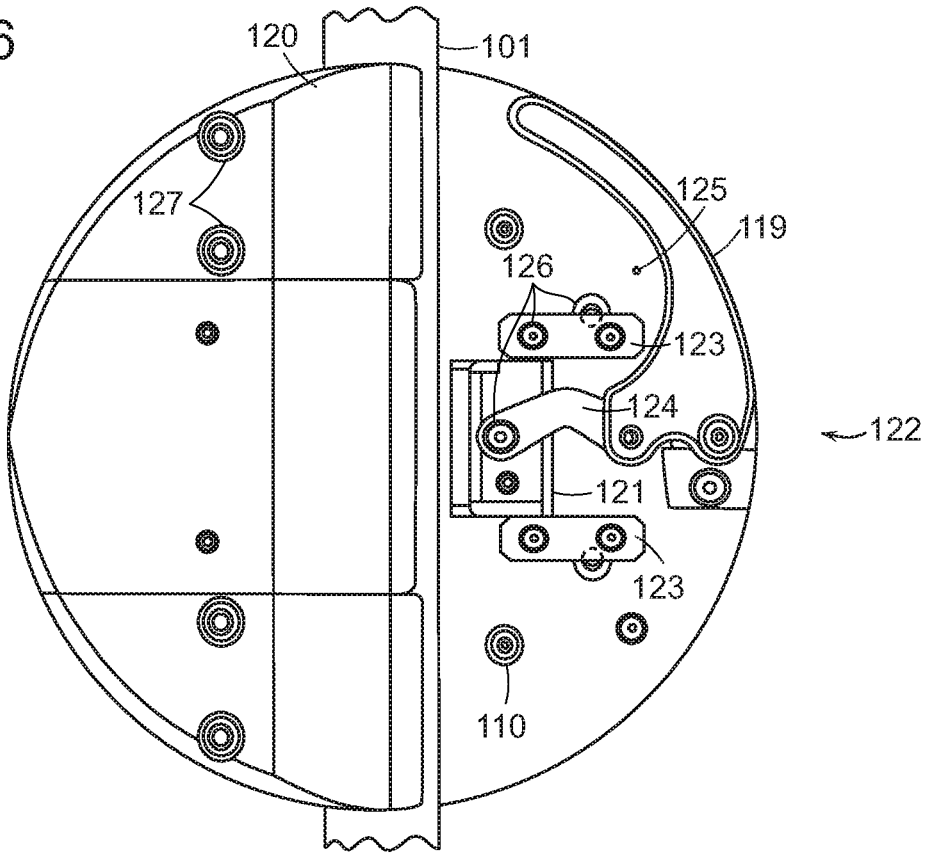

FIG. 12
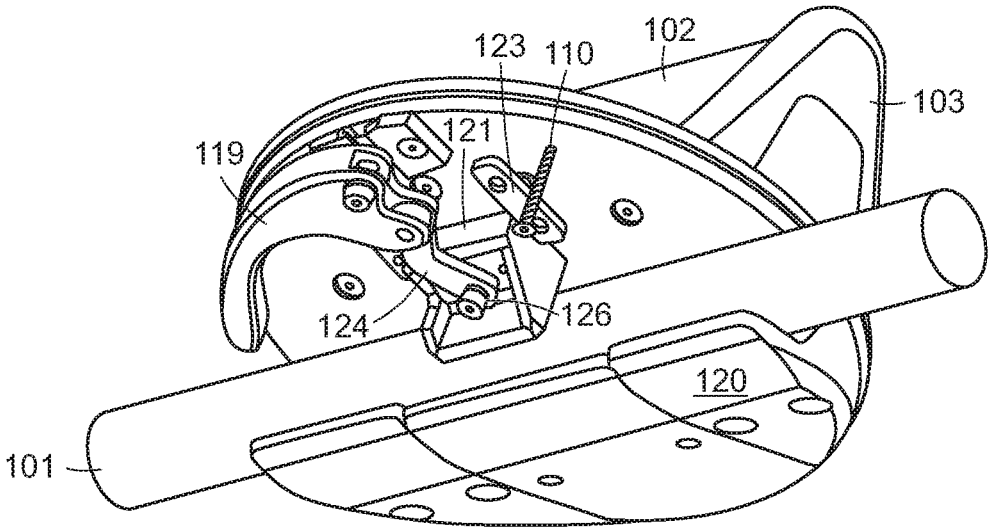
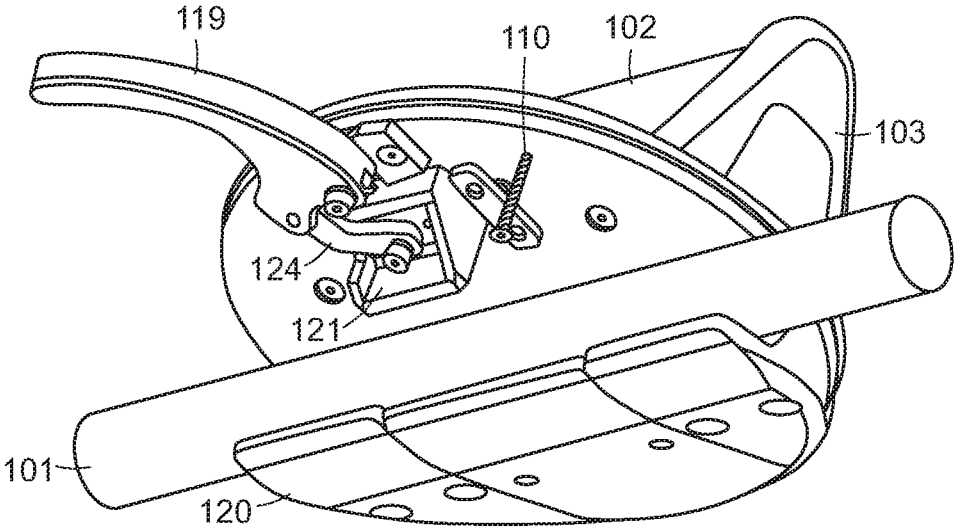
FIG. 13

ROTATABLE HANDLE FOR A DUMBBELL BAR

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to dumbbell bar attachments. More specifically, the presently claimed invention relates to a new dumbbell bar attachment for allowing hand rotation during lifting to reduce the risk of shoulder injury.

2. Description of the Related Art

The related art includes a rotatable handle for a dumbbell bar with a first plate that has an upper face and a lower face, and a second plate that has a top surface and a bottom surface. The bottom surface is pivotally coupled to the upper face so that the first plate and the second plate rotate freely with respect to each other. A handgrip is positioned on the lower face so that it is easy to grasp with the user's hand. A clamp is positioned on the top surface so that it can secure the second plate to the dumbbell bar.

Various attempts have been made to solve the above-mentioned problems such as that found in U.S. Pat. No. 9,630,045 to Martin, Sr. ("the "'045 patent"). This art is representative of rotatable handles for dumbbell bars. None of the above inventions and patents, taken either singly or in combination, is seen to describe the invention as claimed.

However, the screw locking mechanism disclosed in the '045 patent in is time consuming to use, and requires both hands to attach and detach the rotatable handle. This slows down the user's workout routine. In turn, this could effect the thoroughness of the user's workout, especially if they have a limited amount of time to spend at the gym. It could also result in user's skipping the use of the rotatable handle in the interest of saving time, putting themselves at greater risk for injuries.

Ideally, a rotatable handle for a dumbbell bar should provide an easy way for user's to shift their hand position while lifting weights to help avoid injury and, yet would operate reliably and be manufactured at a modest expense. Thus, a need exists for a reliable rotatable handle for a dumbbell bar that can be quickly and easily attached and removed from the dumbbell bar to avoid the above-mentioned problems.

BRIEF SUMMARY OF THE INVENTION

In view of the foregoing disadvantages inherent in the known art, the present invention provides a novel rotatable handle for a dumbbell bar. The general purpose of the present invention, which will be described subsequently in greater detail is to provide a rotatable handle for a dumbbell bar that is quick and easy to attach and remove from the bar, has an ergonomic, non-slip grip, and helps reduce the risk of injury while lifting weights.

The present invention holds significant improvements and meets an important need in weightlifting safety. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention that are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures that accompany the written portion of this specification illustrate embodiments and method(s) of use for the present invention, a rotatable handle for a dumbbell bar, constructed and operative according to the teachings of the present invention.

FIG. 5 is a side view illustrating the clamping mechanism and bar hook of the rotatable handle for a dumbbell bar according to the embodiment of the present invention of FIG. 3.

FIG. 6 is a perspective view illustrating the clamping mechanism and bar hook of the rotatable handle for a dumbbell bar according to the embodiment of the present invention of FIG. 3.

FIG. 12 is a perspective view from below illustrating a rotatable handle for a dumbbell bar according to an embodiment of the presently claimed invention with the clamp locked.

FIG. 13 is a perspective view from below illustrating a rotatable handle for a dumbbell bar according to an embodiment of the presently claimed invention with the clamp unlocked.

The various embodiments of the present invention will hereinafter be described in conjunction with the appended drawings, wherein like designations denote like elements.

DETAILED DESCRIPTION

As discussed above, embodiments of the present invention relate to a rotatable handle for a dumbbell bar and more particularly to a rotatable dumbbell bar handle that is quick and easy to secure and remove from the dumbbell bar, barbell bar, or any other weight bar, to improve the user's grip on a dumbbell bar while lifting, to better prevent injury.

The claimed invention is a piece of workout equipment that is designed to optimize the biomechanics of the human body while weight lifting. The rotatable handle is intended to be used as a pair—one for each hand—and fastens onto a barbell or other weight lifting bar. The user engages a locking lever on the bottom of the device to quickly and securely clamp the product to a weight lifting bar. Once the lever is engaged and the device is secure, the user can grab the rotating Martin Press handles and continue on to lift weights. The Martin Press is strong enough to lift weights in both a pulling (e.g. deadlift) and pushing (e.g. bench press) direction. Additionally, there is a hard stop to prevent over rotation and ensure an optimized range of motion with every lift and prevent injury. The Martin Press has some resemblance of other products designed for pushups, but it is unique in that it is designed for multi-directional weight lifting, and has a quick and easy clamping mechanism, and a hard stop to further prevent injury.

Figure 1:
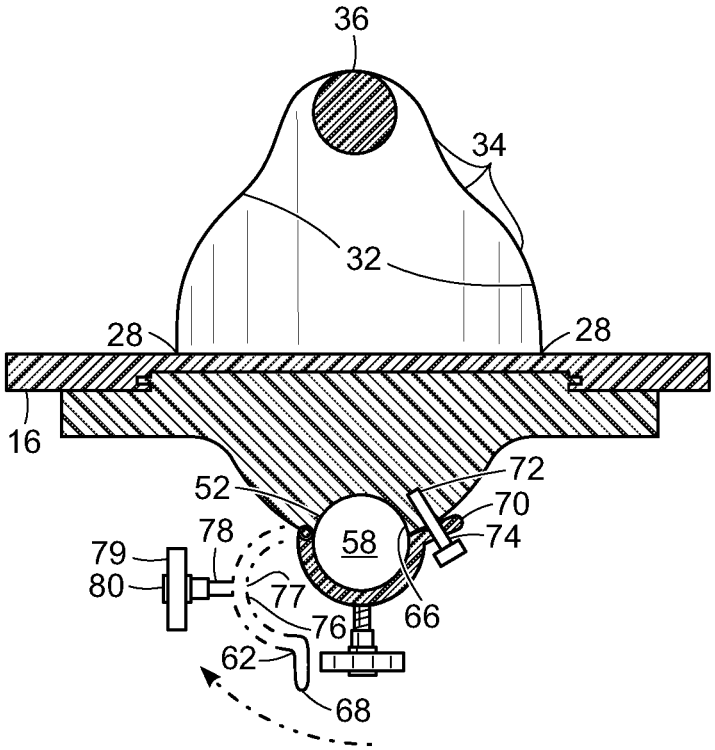
FIG.1 PRIOR ART
FIG. 1 shows a cross-sectional view illustrating a rotatable handle for a dumbbell bar according to a prior art device.
Figure 2:
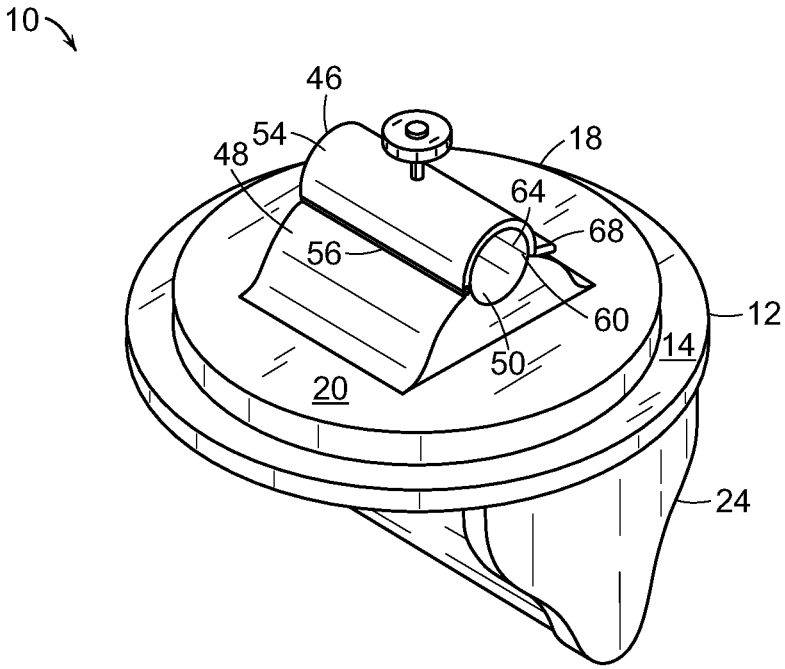
FIG.2 PRIOR ART
FIG. 2 is an isometric perspective view illustrating a rotatable handle for a dumbbell bar according to the prior art device of FIG. 1.
Figure 3:
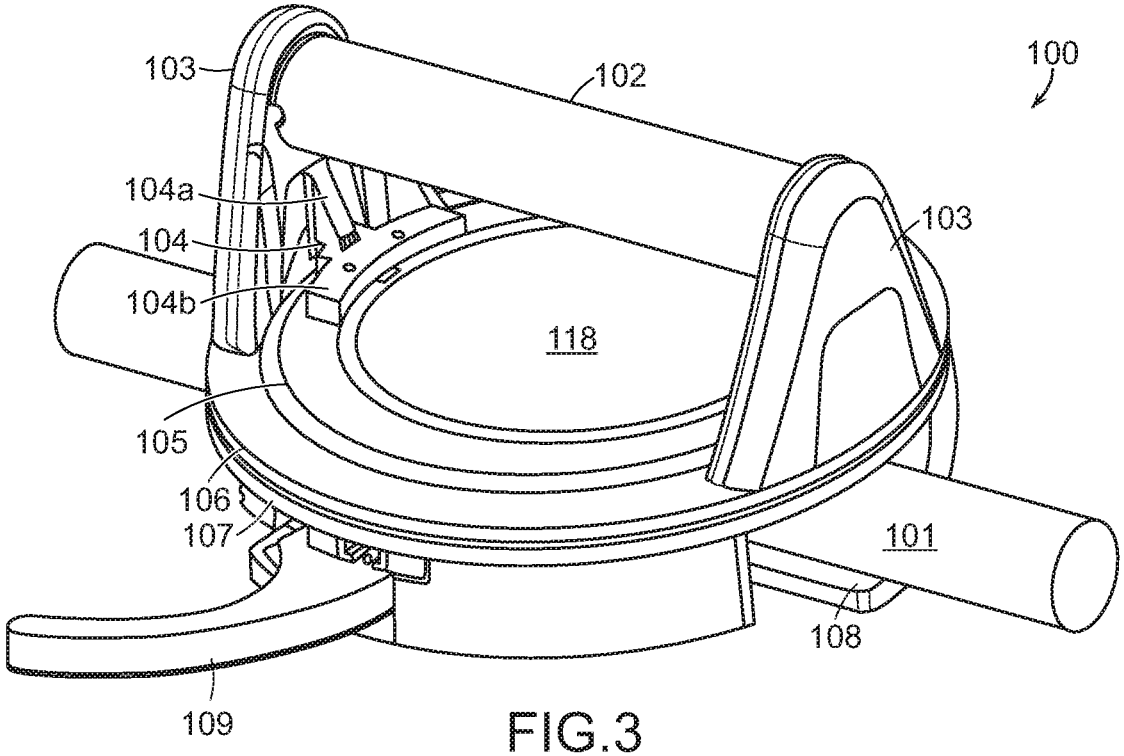
FIG. 3 is a perspective view illustrating a rotatable handle for a dumbbell bar according to an embodiment of the presently claimed invention.

Referring to the drawings by numerals of reference there is shown in FIGS. 1-2, the prior art device with a rotatable handle for a dumbbell bar 10 that includes a round first plate 12 with an upper face 14 and a lower face 16, and a round second plate 12 with a top surface 20 and a bottom surface 22. The bottom surface 22 is coupled to the upper face 14 so that the first plate 12 and the second plate 18 can freely rotate up to 180 degrees with respect to each other. The second plate 18 has a smaller circumference than the first plate 12.

A grip 24 is positioned on the lower face 16 so that it can be grasped by a user. The grip 24 includes a pair of sidebars 26, each with a first end 28 coupled to the lower face 16 at 180 degrees along a perimeter 30 of the first plate 12. The sidebars 26 have opposing edges 32 having three arcuate curves 34 so that the opposing edges 32 meet and define a second end 36 of the sidebars 26. The crossbar 40 is substantially circular when viewed longitudinally, and has an inner surface 42 facing the lower face 16 of the first place 12 with four indentations 44 that are configured to accommodate the four fingers of a hand inserted into the grip 24.

A clamp 46 is coupled to the top surface 20. The clamp 46 is complimentary to a dumbbell bar so that the clamp 46 secures the second plate 18 to the dumbbell bar. The clamp 46 has a base 48 coupled to the top surface 20 of the second plate 18. A channel 50 is located in the top 52 of the base 48. A hinged clasp 54 is coupled to the first edge 56 of the channel 50 so that together the channel 50 and the clasp 54 form a tube 58 when the clasp 54 is closed. The tube 58 is circular when viewed longitudinally, and is formed to hold the dumbbell bar. A first couplet 60 is coupled to a first side 62 of the clasp 54. A second coupler 64 is coupled to the base 48 near a second edge 66 of the channel 50. The second coupler 64 interacts with the first coupler 60 to secure the clasp 54 in a closed position. The first side 62 of the clasp 54 includes an extension 68 with a plurality of holes 70, while the second coupler 64 has a plurality of threaded orifices 72 that are allignable with a respective one of the plurality of holes 70. A plurality of screws 74 are insertedable through each of the respective one of the holes 70 and threadable into a respective one of the orifices 72, such that the clasp 54 is securable around the dumbbell bar. An end of a large threaded screw 76 is positioned at a center 77 of the clasp 54. The threaded screw 76 is is threaded into a hole in a hinged bolt 78 and so that the threaded screw 76 can be tightened to prevent the dumbbell bar from rotating in the tube 58. Each of the screws 74 and the bolt 78 has a tightening ring 79 coupled to a terminus 80 that is distal from the clasp 54.

Referring now to FIGS. 3 and 10-15, an embodiment of the presently claimed invention, a rotatable handle 100 for a dumbbell bar 101. The handle 102 is formed of corrosion resistant metal and knurled like a bench press bar to create a non-slip grip. The handle 102 is held in place by the two handle supports 103. The handle 102 does not need any additional securing method, as the handle supports 103 are sufficient to hold the handle 102 in place. The handle supports 103 are made of corrosion resistant metal and are screwed into the Upper Bearing Wheel 106 with one or more screws 128 each.

The rotatable handle 100 may also have a notch 104 in the handle supports 103 that prevents it from rotating. This hard stop mechanism 104 may be located within at least one of the handle supports 103 and on top of the mushroom bearing clamp 105. The hard stop mechanism 104 may also be located in a more discrete location, such as within the internal bearing mechanism 105, 106, 107. The hard stop mechanism 104 has two parts, a stopper 104*a*, and a rotating block 104*b* that will stop the handle from rotating when they come in contact with each other. This is to prevent the handle 102 from becoming parallel with the weight lifting bar 101, because when they are parallel, the load becomes unstable and potentially unsafe. The hard stops 104 will stop the rotation when the handle 102 is between 5-15 degrees from parallel with the bar 101, regardless of whether the handle 102 is rotating clockwise or counterclockwise with respect to the bar 101.

A black plastic shield part 118 rests on top of the mushroom bearing clamp 105. The black plastic shield part 118 has a concave upper surface to allow more room for the user's knuckles, and shields the bearing raceways 113, 114 from dirt and other grime that could clog up the ball bearings 117.

Figure 4:
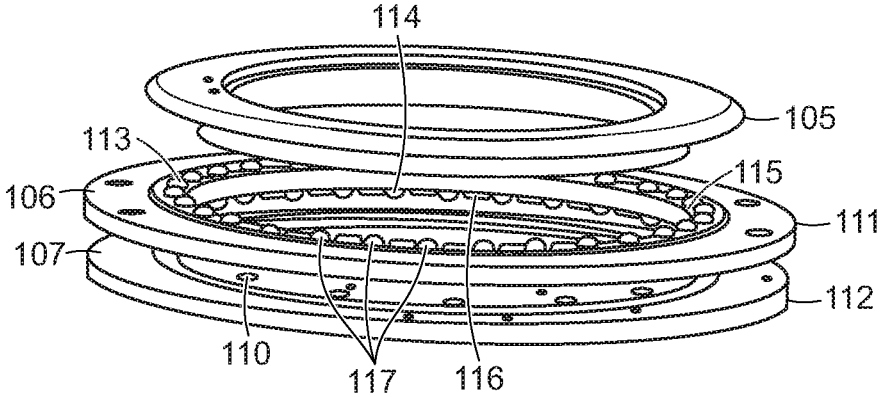
FIG. 4 is a perspective view illustrating the internal bearings and clamps of the rotatable handle for a dumbbell bar according to the embodiment of the present invention of FIG. 3.
Figure 14:
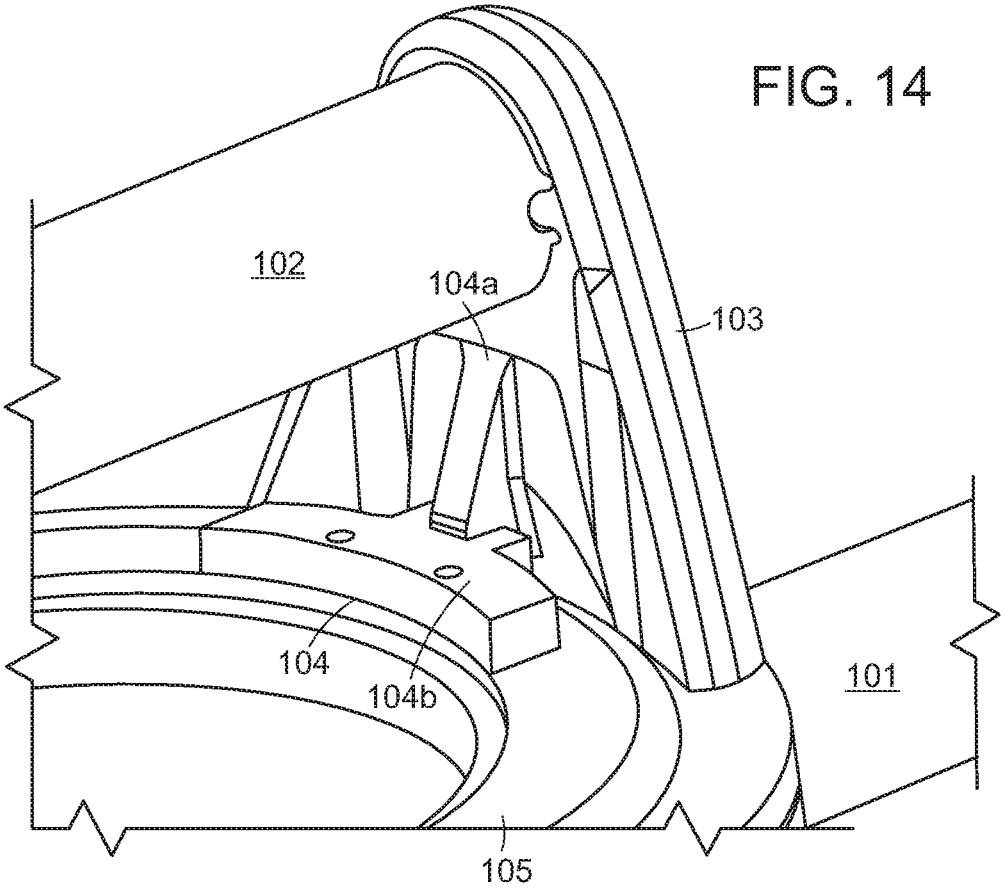
FIG. 14 is a perspective view illustrating the hard stop mechanism to prevent over rotation for the rotatable handle for a dumbbell bar according to an embodiment of the presently claimed invention.
Figure 15:
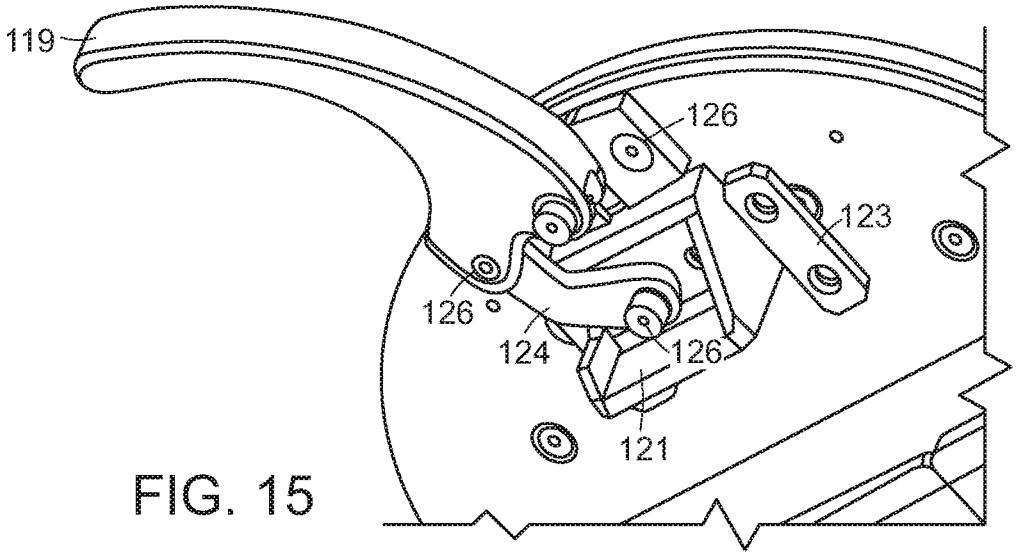
FIG. 15 is a perspective view illustrating the clamping mechanism for the rotatable handle for a dumbbell bar according to an embodiment of the presently claimed invention.

Referring now to FIGS. 4 and 14, the upper bearing wheel 106 is formed from an upper bearing clamp 111 and an upper bearing raceway 113. The lower bearing wheel 107 is formed from a lower bearing clamp 112 and a lower bearing raceway 114. The mushroom bearing clamp 105 is screwed via a threaded screw and hole 110 into the lower bearing clamp 112. The lower bearing clamp 112 and mushroom bearing clamp 105 will sandwich the upper bearing clamp 111 in between. The upper bearing raceway 113 has two sets of ball bearings 117. The ball bearings 117 are loose steel balls that ride in grooves on the bearing raceway between mushroom bearing clamp 105 and the upper bearing clamp 111 and between the upper bearing clamp 111 and the lower bearing clamp 112. The ball bearings 117 are spaced apart from each other with a simple plastic ring 115, 116 that is thin and has holes in it for the ball bearings 117 to ride in. The mushroom bearing clamp 105, the upper bearing clamp 111, and the lower bearing clamp 112, are made of corrosion resistant metal for strength and durability. The dual bearing raceways 115, 116 allow the handle 102 to rotate regardless of the direction in which the force is applied. This is what gives the Martin Press the capability of being used for pulling (e.g. deadlift) and pushing (e.g. bench press).

Referring now to FIG. 5, the user will place the Martin Press 100 over the barbell handle 101 and secure the dumbbell bar 101 in place by pushing the clamp handle 119 inward until the clamp handle 119 snaps into place. The bar hook 120 is tapered to accommodate for slight variations in barbell handle 101 diameters. The bar hook 120 is formed from a corrosion resistant metal, and is attached to the rotatable handle 100 by a plurality of screws 127 as needed to ensure it is securely attached to the lower part.

Referring now to FIG. 6, showing a detailed view of the clamping mechanism 122 for clamping the bar 101. The clamping mechanism 122 includes a clamp handle 119, a clamp block 121, two clamp block guides 123 to guide the clamp block as it is moved by the handle 119, a lever 124 that connects the handle 119 to the clamp block 121, a hard stop 125 to halt the inward rotation of the clamp handle 119 and a plurality of screws 126 as needed to secure the mechanism 122 together and attach it to the rotatable handle 100. The clamp handle 119 designed so that when the clamp block 121 is engaged with the barbell 101, the reactive force of the barbell bar 101 helps the clamping mechanism 122 to stay closed. The clamping mechanism 122 is as an over-center latch, a very stable and secure type of latch that can be opened and closed quickly and efficiently. The clamping mechanism 122 works as follows:

1) The clamp handle 119 is rotated counterclockwise.
2) This pushes the clamp block 121 inward toward the barbell bar 101 via a lever 124 that connects the clamp handle 119 and the clamp block 121
3) The clamp block 121 eventually reaches a point of maximum travel and halts
4) The clamp handle 119 continues to rotate counterclockwise a small distance even after the clamp block 121 reaches its point of maximum travel, as determined by the block supports 123 that secure the clamp block 121 to the rotatable handle 100
5) This pulls the clamp block 121 back outward a small distance away from the barbell bar 101
6) Once the clamp block 121 is past the point of maximum travel, any outward force on the clamp block 121 will force the handle 119 inward to keep the clamping mechanism 122 engaged.

This clamping mechanism makes it possible to clamp and remove the rotatable handle 100 onto and off the bar 101 without having to slide the bar 101 in through a hole or spend time fiddling with screws.

Figure 7:
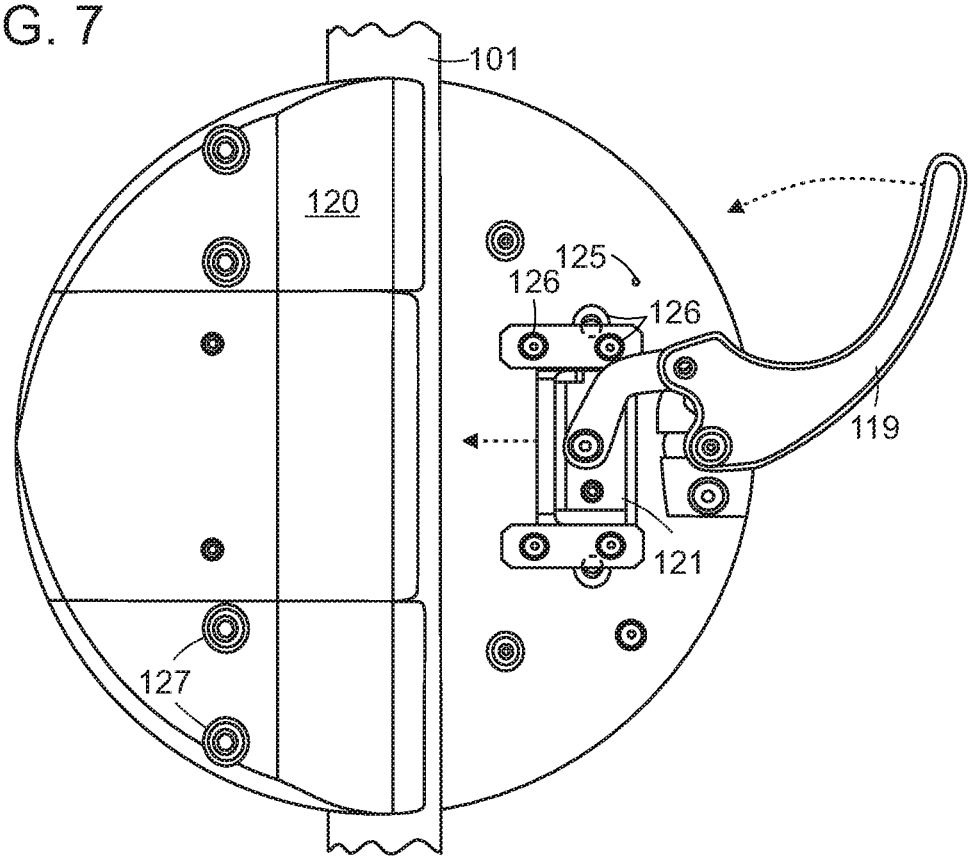
FIG. 7 is a perspective view illustrating the clamping mechanism of the rotatable handle for a dumbbell bar according to the embodiment of the present invention of FIG. 3 when it is not engaged.
Figure 8:
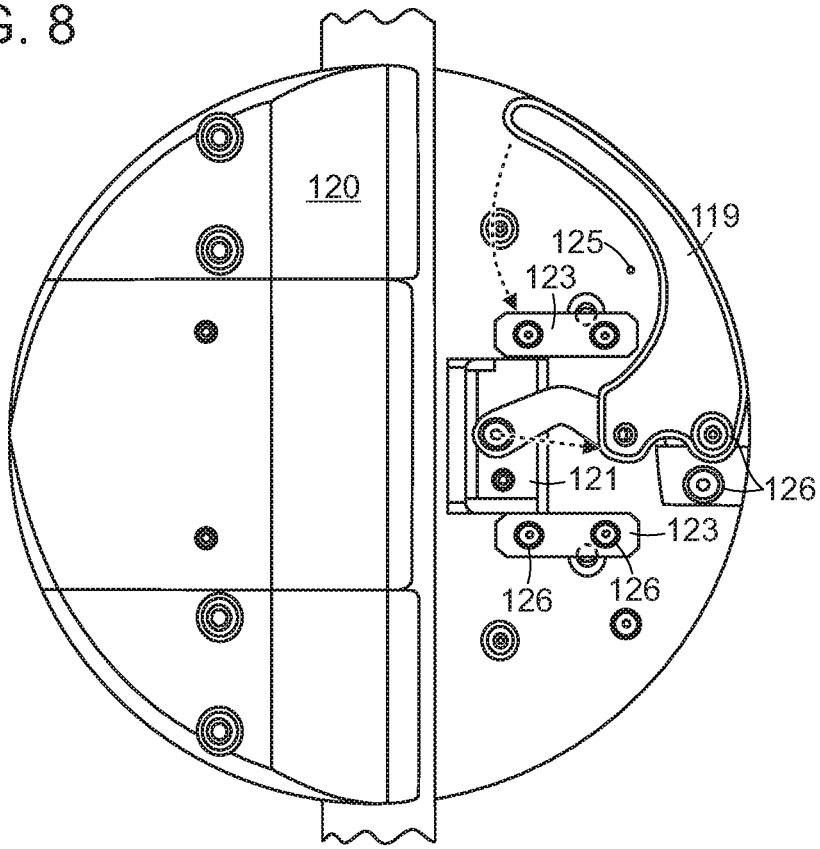
FIG. 8 is a perspective view illustrating the clamping mechanism of the rotatable handle for a dumbbell bar according to the embodiment of the present invention of FIG. 3 when it is engaged.
Figure 9:
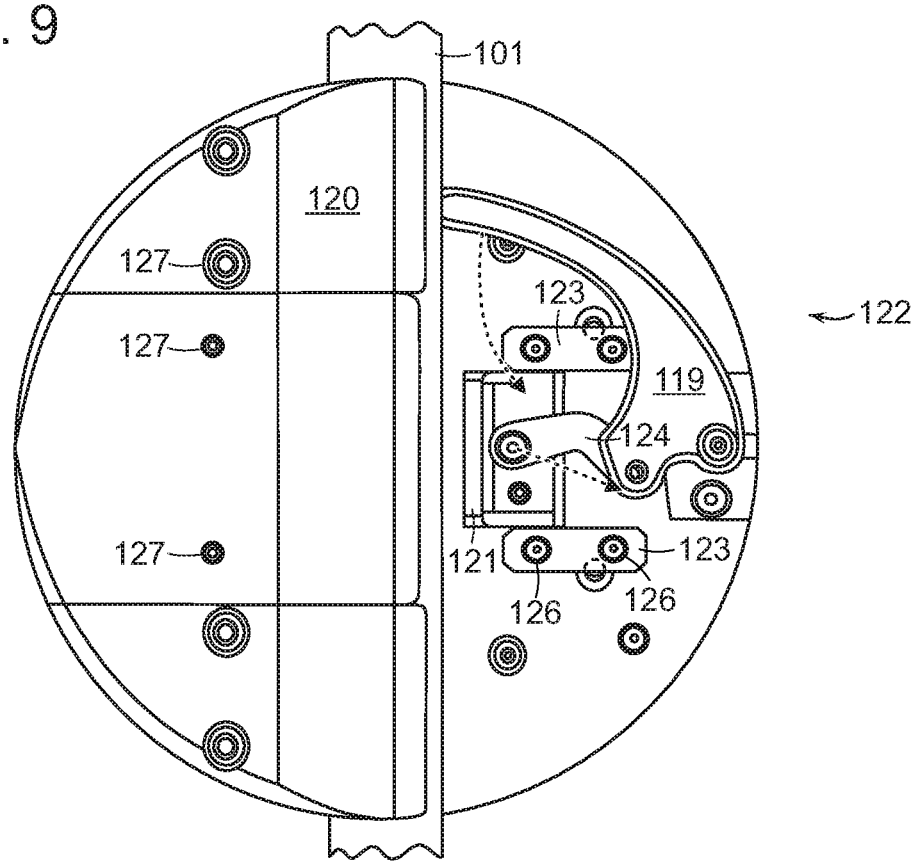
FIG. 9 is a perspective view illustrating an exaggerated locked position of the clamping mechanism of the rotatable handle for a dumbbell bar according to the embodiment of the present invention of FIG. 3.
Figure 10:
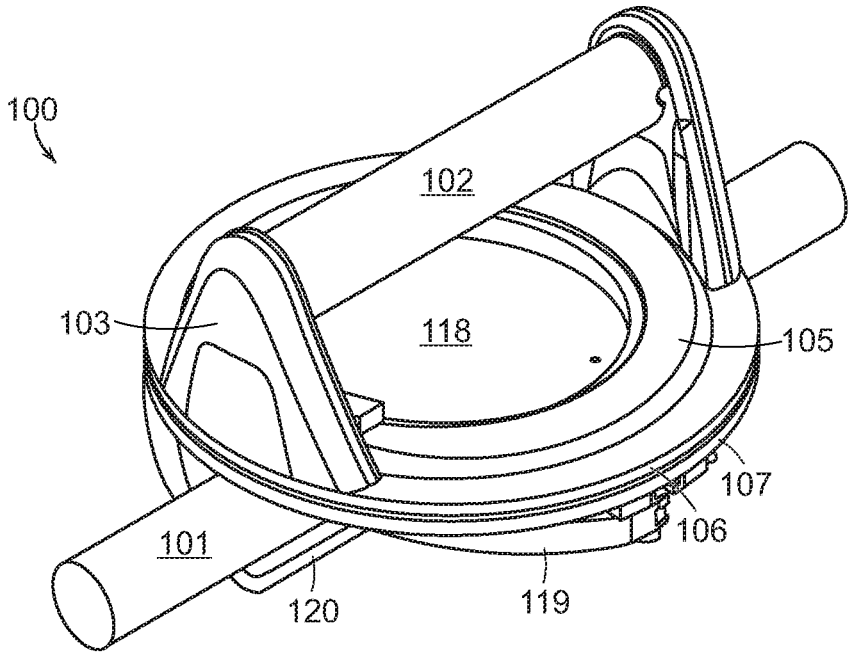
FIG. 10 is a perspective view illustrating a rotatable handle for a dumbbell bar according to an embodiment of the presently claimed invention with the clamping mechanism locked.
Figure 11:
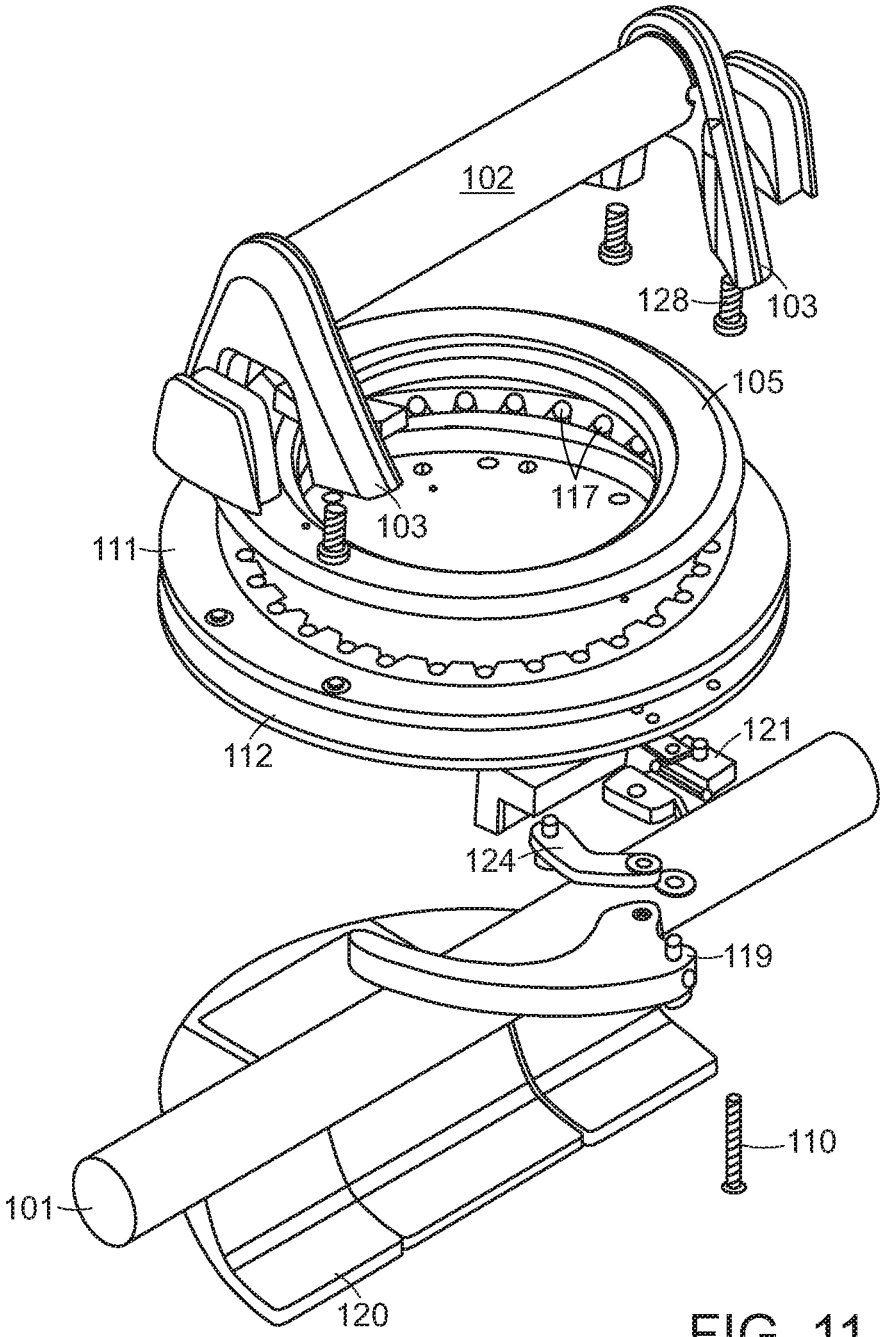
FIG. 11 is an exploded view illustrating the locations of all the internal components respective to each other of the rotatable handle for a dumbbell bar according to an embodiment of the presently claimed invention.

Referring now to FIGS. 7-9, FIG. 7 shows the clamping mechanism 122 when not engaged, while FIG. 8 shows the clamping mechanism 122 when engaged. FIG. 9 shows an exaggerated view of the clamping mechanism 122 moving past the point of maximum travel.

The amount the clamp handle 119 is rotated past the point of maximum travel is very slightly and can hardly be seen, so FIG. 9 shows an exaggerated example of the clamping forces when the clamping mechanism 122 has moved past the point of maximum travel. This example is exaggerated beyond what would be possible in the real product, and is included only to help illustrate how the clamping mechanism 122 works. As shown in FIG. 9, any rightward force on the clamp block 121 works to keep the clamp handle 119 rotated counterclockwise so that it stays locked. The clamp handle 119 is prevented from over-rotating counterclockwise by one ore more hard stops 125.

Most parts in the clamping mechanism will be made using corrosion resistant metal. Rubber and/or plastic components may be used to compensate for the inevitable outward travel of the clamp block 121 when the clamping mechanism 122 is engaged. The inward/outward position of the entire clamping mechanism 122 may be adjustable or fixed in place.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A rotatable handle for a dumbbell bar comprising:
(a) an upper part;
(b) a lower part,
wherein the upper part and the lower part are rotatable with respect to each other;
(c) a rotation mechanism including
(i) an upper bearing wheel including
(1) an upper bearing clamp;
(2) an upper bearing raceway;
(3) a first set of ball bearings spaced apart from each other with a first plastic ring,
wherein the first plastic ring includes holes for the first set of ball bearings to ride within; and
(4) a second set of ball bearings spaced apart from each other with a second plastic ring,
wherein the second plastic ring includes holes for the second set of ball bearings to ride within, and
wherein the upper bearing wheel forms a flat surface of the upper part;
(ii) a lower bearing wheel including
(1) a lower bearing clamp; and (2) a lower bearing raceway, wherein the lower bearing wheel forms a flat surface of the lower part;

(iii) a mushroom bearing clamp, wherein the upper bearing wheel is located between the mushroom bearing clamp and the lower bearing wheel, wherein the mushroom bearing clamp is secured via a threaded screw to the lower bearing clamp, and wherein the first set of ball bearings rides between the mushroom bearing clamp and the upper bearing wheel, and the second set of ball bearings rides between the upper bearing wheel and the lower bearing wheel;

(d) a grip handle;

(e) two grip handle supports, wherein the two grip handle supports secure the grip handle between them, and wherein each grip handle support is attached to the upper bearing wheel by one or more screws;

(f) a rotation hard stop mechanism operably connected to halt the rotation of the upper part with respect to the lower part at a selected degree of rotation, the rotation hard stop mechanism including (i) a rotating block; and (ii) a stopper, wherein the rotation of the upper part with respect to the lower part is halted when the rotating block comes into contact with the stopper;

(g) a bar hook, wherein the bar hook is tapered to allow variation in circumference of the dumbbell bar, and wherein the bar hook is secured to the lower part with a plurality of screws; and (h) a clamping mechanism including (i) a clamp handle;

(ii) a slidable clamp block;

(iii) two clamp block guides, wherein the two clamp block guides are operably connected to the lower part to guide the clamp block;

(iv) a lever, wherein the lever is operably connected to slide the clamp block when the clamp handle is rotated;

(v) at least one clamp handle hard stop, wherein the at least one clamp handle hard stop is operably connected to the lower part to halt the internal rotation of the clamp handle;

(vi) one or more screws.

2. The rotatable handle for a dumbbell bar according to claim 1, wherein the rotation hard stop mechanism is located in at least one of the two grip handle supports.

3. The rotatable handle for a dumbbell bar according to claim 1, wherein the rotation hard stop mechanism is located internally in the rotation mechanism.

4. The rotatable handle for a dumbbell bar according to claim 1, wherein the rotation hard stop mechanism is operably located to stop the rotation of the upper part when the grip handle is 5-15 degrees from parallel with the dumbbell bar.

5. The rotatable handle for a dumbbell bar according to claim 1, wherein the grip handle is formed from a corrosion resistant metal, and wherein the grip handle is knurled to create a non-slip grip.

6. The rotatable handle for a dumbbell bar according to claim 1, wherein the grip handle supports, the upper bearing clamp, the lower bearing clamp, the mushroom bearing clamp, and the bar hook, are formed from a corrosion resistant metal.

7. The rotatable handle for a dumbbell bar according to claim 1, wherein the clamping mechanism is formed from one or more materials selected from the group consisting of a corrosion resistant metal, a rubber material, and a plastic material.

8. The rotatable handle for a dumbbell bar according to claim 1, further comprising:

(i) a shield part having a concave upper surface, wherein the shield part is formed from a plastic material, wherein the concave upper surface of the shield part creates space for a user's knuckles, and wherein the shield part is operably connected to the mushroom bearing clamp to protect the bearing raceways from dirt, grim, or any other substance that could clog the ball bearings and prevent them from rotating.

9. The rotatable handle for a dumbbell bar according to claim 1, wherein a location of the clamping mechanism is adjustable with respect to the lower part.

10. A rotatable handle for a dumbbell bar comprising:

(A) an upper part;

(B) a lower part, wherein the upper part and the lower part are rotatable with respect to each other;

(C) a rotation mechanism including (i) an upper bearing wheel including (1) an upper bearing clamp;

(2) an upper bearing raceway;

(3) a first set of ball bearings spaced apart from each other with a first plastic ring, wherein the first plastic ring includes holes for the first set of ball bearings to ride within; and (4) a second set of ball bearings spaced apart from each other with a second plastic ring, wherein the second plastic ring includes holes for the second set of ball bearings to ride within, and wherein the upper bearing wheel forms a flat surface of the upper part;

(ii) a lower bearing wheel including (1) a lower bearing clamp; and (2) a lower bearing raceway, wherein the lower bearing wheel forms a flat surface of the lower part;

(iii) a mushroom bearing clamp, wherein the upper bearing wheel is located between the mushroom bearing clamp and the lower bearing wheel, wherein the mushroom bearing clamp is secured via a threaded screw to the lower bearing clamp, and wherein the first set of ball bearings rides between the mushroom bearing clamp and the upper bearing wheel, and the second set of ball bearings rides between the upper bearing wheel and the lower bearing wheel;

(D) a knurled grip handle formed from a corrosion resistant metal to create a non-slip grip;

(E) two grip handle supports, wherein the two grip handle supports secure the grip handle between them, and wherein each grip handle support is attached to the upper part by one or more screws;

(F) a rotation hard stop mechanism operably connected to halt the rotation of the upper part with respect to the lower part at a selected degree of rotation, the rotation hard stop mechanism including (i) a rotating block; and (ii) a stopper, wherein the rotation of the upper part with respect to the lower part is halted when the rotating block comes into contact with the stopper, wherein the rotation hard stop mechanism is operably located to stop the rotation of the upper part when the grip handle is 5-15 degrees from parallel with the dumbbell bar, and wherein the rotation hard stop mechanism is located internally in the rotation mechanism;

(G) a bar hook, wherein the bar hook is tapered to allow variation in circumference of the dumbbell bar, and wherein the bar hook is secured to the lower part with a plurality of screws; and (H) a clamping mechanism including (i) a clamp handle;

(ii) a slidable clamp block;

(iii) two clamp block guides, wherein the two clamp block guides are operably connected to the lower part to guide the clamp block;

(iv) a lever, wherein the lever is operably connected to slide the clamp block when the clamp handle is rotated;

(v) at least one clamp handle hard stop, wherein the at least one clamp handle hard stop is operably connected to the lower part to halt the internal rotation of the clamp handle;

(vi) one or more screws;

(I) a shield part having a concave upper surface, wherein the shield part is formed from a plastic material, wherein the concave upper surface of the shield part creates space for a user's knuckles, and wherein the shield part is operably connected to the mushroom bearing clamp to protect the bearing raceways from dirt, grim, or any other substance that could clog the ball bearings and prevent them from rotating.

11. The rotatable handle for a dumbbell bar according to claim 10, wherein the grip handle supports, the upper bearing clamp, the lower bearing clamp, the mushroom bearing clamp, and the bar hook, are formed from a corrosion resistant metal.

12. The rotatable handle for a dumbbell bar according to claim 10, wherein the clamping mechanism is formed from one or more materials selected from the group consisting of a corrosion resistant metal, a rubber material, and a plastic material.

13. The rotatable handle for a dumbbell bar according to claim 10, wherein a location of the clamping mechanism is adjustable with respect to the lower part.

* * * * *